US010480102B2

(12) United States Patent
Stephan

(10) Patent No.: US 10,480,102 B2
(45) Date of Patent: Nov. 19, 2019

(54) MAINTENANCE DEVICE FOR THE MAINTENANCE OF WORK STATIONS OF A TEXTILE MACHINE AND A TEXTILE MACHINE

(71) Applicant: Maschinenfabrik Rieter AG, Winterthur (CH)

(72) Inventor: Adalbert Stephan, Beilngries/Paulushofen (DE)

(73) Assignee: MASCHINENFABRIK RIETER AG, Winterthur (CH)

( * ) Notice: Subject to any disclaimer, the term of this patent is extended or adjusted under 35 U.S.C. 154(b) by 143 days.

(21) Appl. No.: 15/689,212

(22) Filed: Aug. 29, 2017

(65) Prior Publication Data

US 2018/0057967 A1 Mar. 1, 2018

(30) Foreign Application Priority Data

Aug. 29, 2016 (DE) ..... 10 2016 116 006

(51) Int. Cl.
*D01H 13/00* (2006.01)
*D01H 15/013* (2006.01)
*D01H 15/00* (2006.01)

(52) U.S. Cl.
CPC ..... *D01H 13/005* (2013.01); *D01H 15/013* (2013.01); *D01H 15/002* (2013.01)

(58) Field of Classification Search
CPC ..... D01H 13/005; D01H 13/26; D01H 15/00; D01H 15/002; D01H 15/013; D01H 9/10
(Continued)

(56) References Cited

U.S. PATENT DOCUMENTS 3,651,628 A * 3/1972 Harmon ..... D01H 13/005 57/1 R
3,936,995 A * 2/1976 Laflaquiere ..... D01H 1/16 57/1 R
(Continued)

FOREIGN PATENT DOCUMENTS

DE 36 02 961 A1 8/1987
DE 199 30 644 A1 1/2001
(Continued)

OTHER PUBLICATIONS

EPO Search Report, dated Jan. 15, 2018.
German Patent Office Search Report, dated Apr. 27, 2017.

*Primary Examiner* — Khoa D Huynh
*Assistant Examiner* — Grace Huang
(74) *Attorney, Agent, or Firm* — Dority & Manning, P.A.

(57) ABSTRACT

A maintenance device for servicing adjacent work stations of a textile machine includes an operating unit that further comprises at least one operating component configured to perform a service operation at the work stations. Driving rails are disposed alongside the workstations, and a guide moves the maintenance device on the driving rails in a direction of travel alongside the work stations. The maintenance device moves on the driving rails from a maintenance position in which one of the work stations is serviceable by the maintenance device into an inspection position in which the maintenance device can be inspected. For transport of the maintenance device from the maintenance position into the inspection position, the operating unit is pivotal relative to the guide unit and/or the operating component is movable relative to the operating unit.

11 Claims, 3 Drawing Sheets

(58) Field of Classification Search
USPC ..... 57/22, 136
See application file for complete search history.

(56) References Cited

U.S. PATENT DOCUMENTS

| | | | | | |
|---|---|---|---|---|---|
| 4,192,129 | A * | 3/1980 | Stahlecker | D01H 4/48 | 57/261 |
| 4,275,554 | A * | 6/1981 | Tarbon | D01H 13/005 | 57/1 R |
| 4,840,022 | A | 6/1989 | Karl et al. | | |
| 4,890,450 | A * | 1/1990 | Karl | B65H 54/26 | 57/1 R |
| 5,090,190 | A * | 2/1992 | Slavik | D01H 13/005 | 57/262 |
| 6,474,461 | B1 * | 11/2002 | Grabovszky | B65H 54/26 | 198/345.3 |
| 6,772,697 | B2 * | 8/2004 | Stephan | D01H 3/005 | 104/264 |
| 7,257,878 | B2 * | 8/2007 | Locher | H01R 43/05 | 29/33 F |
| 2003/0098029 | A1 * | 5/2003 | Wolff | A24D 3/022 | 131/68 |

FOREIGN PATENT DOCUMENTS

| | | | |
|---|---|---|---|
| DE | 101 30 467 | A1 | 1/2006 |
| DE | 10 2006 007922 | A1 | 8/2007 |
| DE | 10 2010 001475 | A1 | 8/2011 |
| DE | 10 2012 008706 | A1 | 10/2013 |

* cited by examiner

MAINTENANCE DEVICE FOR THE MAINTENANCE OF WORK STATIONS OF A TEXTILE MACHINE AND A TEXTILE MACHINE

FIELD OF THE INVENTION

The invention relates to a maintenance device for servicing adjacent work stations of a textile machine, in particular a spinning machine, comprising an operating unit, which features at least one operating component for servicing the work stations, and with a guide unit, by means of which the maintenance device can be moved on a driving rail along the work stations and which defines a direction of travel of the maintenance device. The maintenance device can be transported from a maintenance position, in which one of the work stations can be serviced by the maintenance device, into an inspection position, in which the maintenance device can be inspected. Furthermore, the invention relates to a corresponding textile machine with a maintenance device.

BACKGROUND

DE 36 02 961 C2 discloses a device for servicing work stations, which can be moved on a running rail. If there is any damage, or upon the regular inspection of the device, this device must, of course, itself be inspected. For this purpose, the device for inspection, together with a part of the running rail, is pivoted with respect to the work stations, such that the device is in an inspection position and can be inspected. An additional maintenance device can thereby enter the working path of the maintenance device to be inspected, and temporarily take over the maintenance of the work stations located there. With this state of the art, it is disadvantageous that the pivotable running rail is elaborately designed.

SUMMARY OF THE INVENTION

Thus, a task of the present invention is to remedy the disadvantage of the state of the art. Additional objects and advantages of the invention will be set forth in part in the following description, or may be obvious from the description, or may be learned through practice of the invention.

The task is solved by a maintenance device and a textile machine with the characteristics as described and claimed herein.

A maintenance device for the maintenance of work stations of a textile machine, which can be moved on a driving rail along the work stations, and a corresponding textile machine with such a maintenance device, are proposed. In the event of a failure or for inspecting, cleaning or repairing a work station (for example), the maintenance device travels to it, in order to carry out the corresponding activity at the work station. For this purpose, the maintenance device comprises an operating unit, which features at least one operating component for servicing the work stations. Furthermore, the maintenance device comprises a guide unit, by means of which the maintenance device can be moved on the driving rail along the work stations, and which defines a direction of travel of the maintenance device. The guide unit may comprise rollers (for example), such that the maintenance device can be moved along the driving rail. In doing so, the arrangement of the rollers at the same time also defines the direction of travel. The maintenance device can be transported from a maintenance position into an inspection position and back. In the maintenance position, the work station that is approached can be serviced by the maintenance device. In the inspection position, however, the maintenance device itself can be inspected. Of course, the inspection of the maintenance device or maintenance of the work station is also understood to mean activities such as, for example, cleaning, repairing and/or eliminating an error or another activity that is to be carried out at and/or by the maintenance device.

It is provided that, for the transport of the maintenance device from the maintenance position into the inspection position, the operating unit can be pivoted with respect to the guide unit, and/or the at least one operating component can be moved (in particular, can be pivoted) with respect to the operating unit. As a result, the guide rail as well as the guide unit can remain on the spinning machine during pivoting, such that they can be designed in a simple manner. The driving rail or the textile machine does not have to feature a separate service position or other arrangements in order to transport the maintenance device into its maintenance position. Likewise, it is not necessary to remove the maintenance device from the textile machine in order to inspect it. By pivoting the operating unit and/or moving the at least one operating component, the operating personnel can easily reach the maintenance device or its operating component(s) from several (preferably all) sides in order to completely inspect the maintenance device. It is also advantageous that the maintenance device can be inspected at any desired position on the textile machine, and not has to be transported into a specific service position, for example, at one of the ends of the textile machine. After the inspection of the maintenance device, it can, of course, be brought back into the maintenance position.

Furthermore, it is advantageous if the at least one operating component can be moved, for the purpose of inspection, by the operating unit from the maintenance position into the inspection position; for example, it can be extended by means of a linkage. Thus, the operating component can be pulled away from the work station for inspection, such that the personnel can inspect the component in a simple manner. If the at least one operating component of the maintenance device is pivotable with respect to the operating unit, this also simplifies the inspection of the maintenance device or of the individual operating components to be inspected. The individual operating components can be pivoted from the maintenance position, in which they can service the work stations, to the inspection position, in which they can be inspected themselves, whereas a multiple number of operating components can be pivoted together, or only one operating component can be pivoted in and of itself. A combination of one pivotable operating unit and one or more operating components that can additionally be moved with respect to the operating unit is also conceivable.

Advantageously, the operating unit and/or the at least one operating component is pivoted with respect to the guide unit or the operating component is pivoted with respect to the operating unit by means of a swivel joint. For example, the swivel joint may be a hinge.

Furthermore, it is advantageous if the operating unit and/or the individual operating component can be pivoted around a first pivot axis, which is perpendicular to the direction of travel. Since the work stations are usually arranged next to one another, the direction of travel is usually oriented horizontally. The first pivot axis is then a vertical line, around which the operating unit and/or the individual operating component is pivoted. By this, the operating unit and/or the individual operating components are swiveled (for example, in a manner similar to a door), and are then conveniently accessible by the personnel.

It is also advantageous if the operating unit and/or the operating component can be pivoted around a second pivot axis. The second pivot axis is aligned parallel to the direction of travel. The operating unit and/or the individual operating component(s) can be turned upwards or downwards from the work stations, such that the operating unit and/or the operating component(s) can be reached by the personnel.

Furthermore, it is advantageous if the operating unit features a multiple number of operating components, which, for the purpose of inspection, are arranged so as to be movable together with respect to the operating unit on the maintenance device. The multiple number of operating components are preferably arranged on a common carrier. Thus, in a time-saving manner, a multiple number of operating components can be transported into the inspection position and inspected at one time.

It is also advantageous if the maintenance device comprises a device for the supply of energy, which is connected to the operating unit and/or the at least one operating component in the maintenance position and in the inspection position of the maintenance device. Thus, the function of the operating unit or of the at least one operating component can also be examined in the inspection position. It is also possible to make adjustments to the operating components. The device for the supply of energy may comprise, for example, electrical supply lines and/or compressed air supply lines and/or vacuum supply lines. A connection of the supply lines is preferably arranged in a fixed manner on the maintenance device. However, it can be provided that individual supply lines are arranged in a movable manner on the operating unit, an operating component or a carrier, in order to enable the movement of the operating unit or the operating component.

Furthermore, it is advantageous if the maintenance device comprises a safety device for avoiding collisions, which is effective both in the maintenance position and for the maintenance device located in the inspection position. The safety device may be designed, for example, as a reversing bracket, which extends in the direction of travel away from the maintenance device. If, during the moving of the maintenance device, the reversing bracket meets an obstacle, or if the reversing bracket is hit by an arriving, moving obstacle or is otherwise actuated, the direction of travel is reversed in the conventional manner and/or the drive is blocked, in order to avoid a collision. This safety function is also ensured in the case of maintenance equipment located in the inspection position. If the safety device is designed as a reversing bracket, it is arranged on the first maintenance device part, and is thus not pivoted during the pivoting of the second maintenance device part.

However, in addition or alternatively, it is also conceivable for the maintenance device to comprise a safety device for avoiding collisions, which can be activated through the transport of the maintenance device from the maintenance position into the inspection position, preferably automatically.

It is also advantageous if the maintenance device comprises a safety device, with the assistance of which at least one part of the maintenance device can be switched off in the inspection position of the maintenance device. The safety device may, for example, disconnect the maintenance device and/or the individual operating components, such that, during inspection, injuries to personnel can be prevented. Likewise, for example, the drive of the maintenance device can be deactivated in order to avoid injury to persons and damages to the operating unit or the operating component (s).

It is also advantageous if the maintenance device features at least one actuator, by means of which the operating unit and/or the operating component can be pivoted and/or moved. This simplifies the movement of the operating unit and/or the operating component. The actuator may comprise, for example, an electric motor.

Furthermore, it is advantageous if the angle between the inspection position and the maintenance position is between 45° and 180°. By this, the maintenance device and/or the operating component can be easily reached.

BRIEF DESCRIPTION OF THE DRAWINGS

Further advantages of the invention are described in the following embodiments. The following is shown.

DETAILED DESCRIPTION

Figure 1:
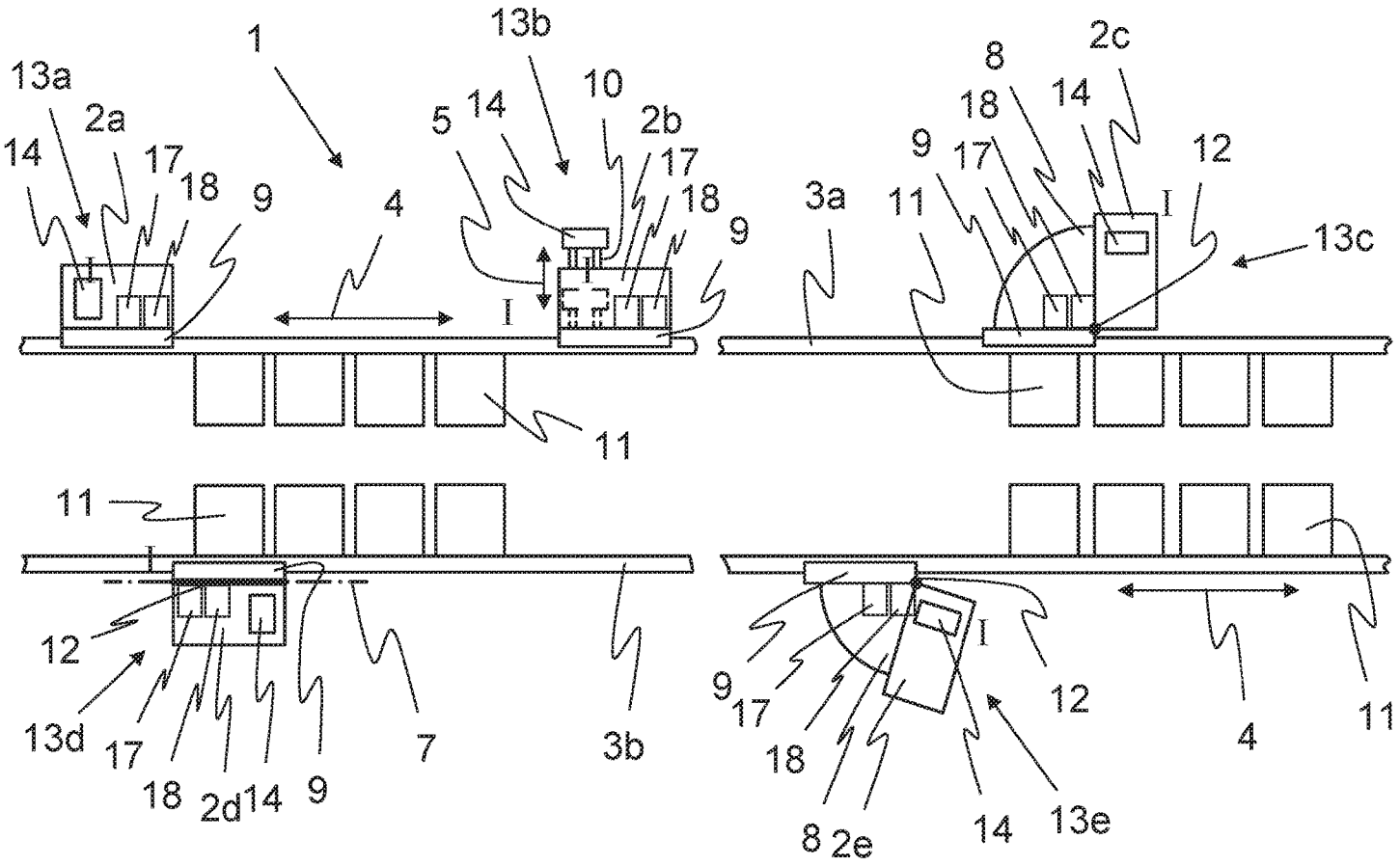
FIG. 1 is a top view of a cut-out of a textile machine with a driving rail and a multiple number of maintenance devices.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a schematic top view of a cut-out of a textile machine 1 with two driving rails 3*a*, 3*b*, in the present case arranged opposite one another on the textile machine 1, and five maintenance devices 13*a*-13*e*, whereas the driving rails 3*a*, 3*b* extend along the textile machine 1. The textile machine 1 furthermore features a multiple number of similar work stations 11 arranged side by side, which also extend along the textile machine 1 and thus along the running rail 3*a*, 3*b*, whereas only a part of the work stations 11 is provided with a reference sign. The textile machine 1 may feature work stations 11 on its two opposite longitudinal sides (as in the present case) or only on one longitudinal side.

In addition, the driving rails 3*a*, 3*b* may also be connected by means of a round arch to a single driving rail 3, which extends around it on at least one transverse side of the textile machine 1. In the present case, however, the driving rails 3*a*, 3*b* comprise two separate driving rails 3*a*, 3*b*, whereas each driving rail 3*a*, 3*b* is arranged on a respective longitudinal side of the textile machine 1. In this case, the rails 3*a*, 3*b* are connected in a fixed manner to the textile machine 1 and remain on the textile machine 1 during the maintenance of the maintenance devices 13*a*-13*e*.

In this embodiment, three maintenance devices 13*a*-13*c* are arranged on the driving rail 3*a* so as to be moved to both sides in a direction of travel 4 along the driving rail 3*a*. In the present case, two maintenance devices 13*d*, 13*e* are arranged on the driving rail 3*b* so as to be movable to both sides in the direction of travel 4. Such an arrangement of the maintenance devices 13*a*-13*e* on the two driving rails 3*a*, 3*b* is selected only as an example. The textile machine 1 may also feature more or fewer maintenance devices 13*a*-13*e*.

In addition, each of the maintenance devices 13*a*-13*e* features a guide unit 9 that fixes the maintenance devices 13*a*-13*e* to the driving rails 3*a*, 3*b*, and by means of which the maintenance devices 13*a*-13*e* can be moved on the driving rails 3*a*, 3*b*. The guide unit 9 defines the direction of travel 4 of the maintenance devices 13*a*-13*e*, for example through the manner of the arrangement of casters or through a specific formation of the guide that prescribes the direction of travel 4.

Each of the maintenance devices 13*a*-13*e* features an operating unit 2*a*-2*e*, by means of which the work stations 11 of the textile machine 1 can be serviced. Each of the operating units 2*a*-2*e* features at least one operating component 14 for this purpose. For example, in the present illustration, the maintenance device 13*d* is moved to a work station 11 to be serviced and placed in front of it, in order to carry out a corresponding maintenance, repair or similar activity at such work station 11. The operating component 14 can be formed, for example, as a coil changer, as a piecing device, as a cleaning device, or as a part of the specified devices, for example as a pneumatic thread handling element, as a thread end preparation unit, as a rotor cleaning unit, or the like. The maintenance devices 13*a*-13*e* may also clean the work stations 11, for example by means of a suction system.

Since the maintenance devices 13*a*-13*e* comprise at least one, but usually several, complex control components 14, the maintenance devices 13*a*-13*e* themselves must be inspected, serviced, cleaned and/or repaired from time to time. For this purpose, the maintenance devices 13*a*-13*e* can be brought from a maintenance position I into an inspection position II. In the maintenance position I, the maintenance devices 13*a*-13*e* can service the work stations 11. In the inspection position II, the maintenance devices 13*a*-13*e* may themselves be inspected. The maintenance devices 13*a* and 13*d* are shown here, for example, in the maintenance position I. The maintenance devices 13*a* and 13*d* are arranged close to the textile machine 1 and/or at the work stations 11. By contrast, the maintenance devices 13*b*, 13*c* and 13*e* are shown by way of example in a particular formation of the inspection position II.

The maintenance device 13*b* is shown, for example, in an inspection position II, in which at least one of the operating components 14 has moved out of the operating unit 2*b*, such that it is accessible to an operator from multiple sides, in order to be inspected. For this purpose, the operating component 14 is shifted into the inspection position II by a gap 5 from its maintenance position I shown in dashed lines. For this purpose, the maintenance device 13*b* may, for example, feature a linkage 10, by means of which the operating component 14 can be moved with respect to the operating unit 2*b*. However, the at least one operating component 14 or a multiple number of operating components 14 can also be moved in a different manner, by means of a linkage 10 or a swivel joint 12, with respect to the maintenance device 13 or the operating unit 2, as shown in FIGS. 2-5.

The maintenance devices 13*c*, 13*e* are shown in a further specific embodiment of the inspection position II. In this case, each of the two operating units 2*c*, 2*e* is pivoted away at an angle from its driving rail 3*a*, 3*b* by a first pivot axis 6 (perpendicular to the page in FIG. 1 and identified in FIGS. 2 and 4) that extends perpendicularly to the direction of travel 4 of the maintenance devices 13*a*-13*e*. For this purpose, the operating units 2*c*, 2*e* can be pivoted with respect to the guide units 9 by means of a swivel joint 12. The guide units 9 remain arranged on the driving rail 3*a*, 3*b*. The guide rails 3*a*, 3*b* also remain fixed to the textile machine 1, such that they can be designed in a simple manner and do not require any precautions to transport the maintenance devices 13*a*-13*e* into their inspection position II. In this embodiment as well, the personnel can easily inspect the maintenance devices 13*c*, 13*e* and/or the individual operating components 14, since their sides turned towards them in the operation of the textile machine 1 or the work stations 11 are also accessible.

The maintenance device 13*d* can also be transported into its inspection position II, in such a manner that its operating unit 2*d* can be pivoted with respect to the guide unit 9. For this purpose, the operating unit 2*d* may be pivoted around a second pivot axis 7, which is aligned parallel to the driving rail 3*b* or to the direction of travel 4. The maintenance device 13*d* or its operating unit 2*d* may, for example, be turned upwards or downwards, or simply rotated around an axis of the maintenance device 13*d* or the operating unit 2*d*, in order to inspect them. The pivot axis 7 can be located at various positions in relation to a height H of the maintenance device 13 (the height H is shown only by way of example in FIGS. 2-5). If the pivot axis 7 is located in a central area of the maintenance device 13 in relation to its height H, only a small space requirement is required for pivoting the operating unit 2*d*. However, it can also be advantageous to provide the pivot axis 7 in an upper or lower area of the maintenance device 13, such that the operating unit 2*d* can be tilted upwards or downwards out of the maintenance device 13, as a result of which the operating components 14 are particularly accessible.

The pivoting of the operating unit 2 with respect to the guide unit 9 around the first pivot axis 6 or the second pivot axis 7 has been described only by way of example with reference to the maintenance devices 13*c*, 13*d*. It is, of course, also conceivable for an operating unit 2 to be pivoted around a first pivot axis 6 and around a second pivot axis 7, in order to improve the accessibility of the operating components 14. In addition, it is, of course, also conceivable to combine an operating unit 2, which is pivotable with respect to the guide unit 9, with one or more operating components 14, which are movable separately with respect to the operating unit 2, as shown in FIGS. 2-5. In each case, upon the pivoting of the operating unit 2, it is advantageous that a device for the supply of energy 16 (see FIGS. 2-5) with its supply lines can be arranged close to the pivot axis 6, 7 and is thus exposed to only slight loads during pivoting, as shown in the following with reference to FIGS. 2-5.

It is also advantageous if the maintenance devices 13*a*-13*e* feature at least one actuator 18 (indicated schematically in FIG. 1), by means of which the operating unit 2*b* and/or the operating component 14 can be pivoted and/or moved. This simplifies the movement of the operating unit and/or the operating component. The actuator 18 may comprise, for example, an electric motor.

Furthermore, it is advantageous if the maintenance devices 13*a*-13*e* comprise a safety device 17 (indicated schematically in FIG. 1) for avoiding collisions, which is effective both in the maintenance position and for the maintenance device located in the inspection position.

Figure 2:
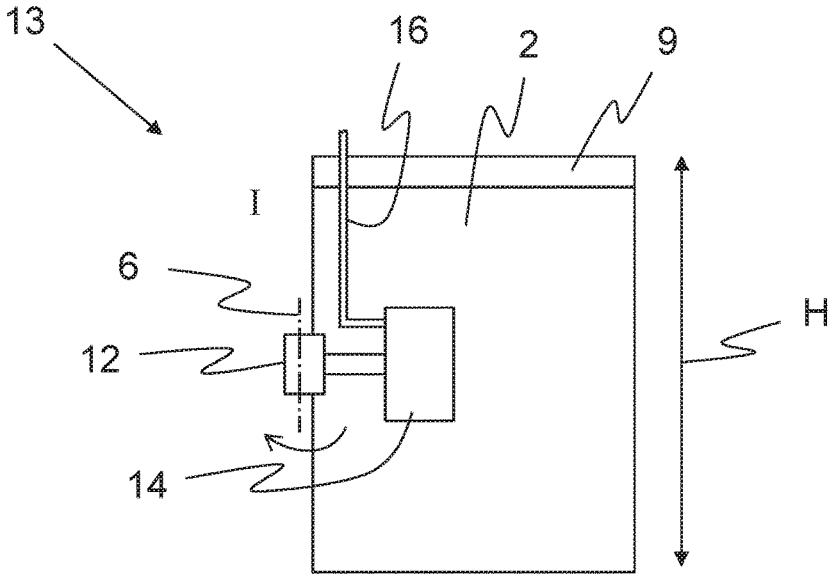
FIG. 2 is a schematic front view of a maintenance device with a pivotable operating component.

FIG. 2 shows a schematic front view of a maintenance device 13 with a pivotable operating component 14. As symbolized by an arrow, the operating component 14 is pivotable around a first pivot axis 6, which is oriented perpendicularly to the direction of travel 4 (see FIG. 1), in order to transport the maintenance device 13 from its maintenance position I shown in the present case into its inspection position II, which is not shown here. For this purpose, the operating component 14 is attached to the operating unit 2 by means of a swivel joint 12. Furthermore, a device 16 for the supply of energy is shown, which supplies the operating unit 14 with power and/or compressed air and/or a vacuum. If the device 16 for the supply of energy is arranged close to the pivot axis 6 as shown in the present case, the operating component 14 can be pivoted without difficulty into the inspection position II, without physically stressing the supply lines of the device 16 for the supply of energy. Of course, a multiple number of operating components 14 can be arranged in a manner individually pivotable on the operating unit 2. It is, of course, also possible for the pivot axis 6 to not extend, as shown here, to the lateral edge of the operating unit, but to extend, for example, into a central area.

Figure 3:
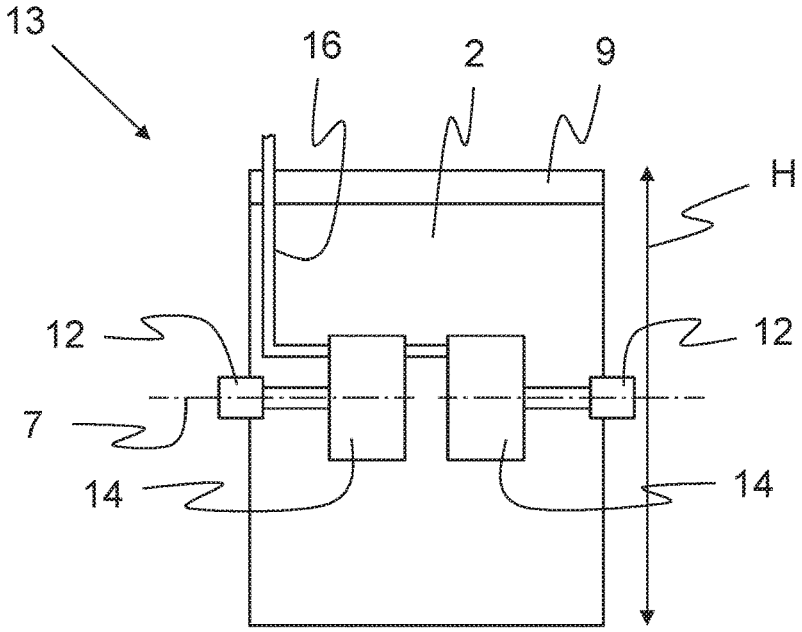
FIG. 3 is a schematic front view of a maintenance device with pivotable operating components according to another design.

FIG. 3 shows another design of a maintenance device 13 with a pivotable operating component 14. In the present case, two operating components 14 are provided, which can be pivoted around a second pivot axis 7 (see arrow) aligned parallel to the direction of travel 4 (see FIG. 1). Here as well, it is once again advantageous if the device 16 for the supply of energy is located close to the pivot axis 7. The pivot axis 7 is arranged essentially in the middle of the operating components 14, but the pivot axis 7 could also be arranged at a lower or upper end of the operating components 14, such that they can be folded out upwards or downwards from the operating unit 2. Furthermore, the pivot axis 7 could, of course, also be arranged at a different location relative to the height H of the maintenance device 13. Of course, in this design as well, more or fewer operating components 14 can be provided on the operating unit 2.

FIGS. 2 and 3 show operating units 14 that can be pivoted either around a pivot axis 7 aligned parallel to the direction of travel 4 (see FIG. 1) or around a pivot axis 6 aligned perpendicular to it. Of course, the operating components 14 or even only a part of the operating components 14 can also be pivotable around two different pivot axes 6, 7. Moreover, the operating components 14 of an operating unit 2 need not necessarily be pivotable around the same pivot axis 6, 7; rather, each operating component 14 may also feature its own pivot axis 6, 7.

Figure 4:
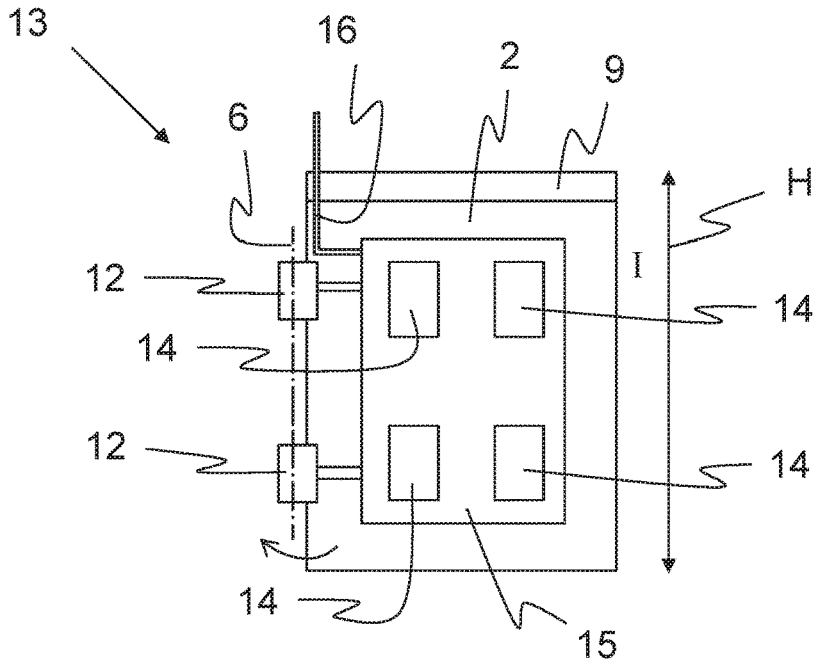
FIG. 4 is a schematic front view of a maintenance device with pivotable operating components arranged on a carrier.

FIG. 4 shows an additional maintenance device 13 in a schematic front view. The operating components 14 of the operating unit 2 are arranged on a common carrier 15 that, in turn, can be pivoted with respect to the operating unit 2 around a pivot axis 6 (see arrow) aligned perpendicular to the direction of travel 4 (see FIG. 1). The device 16 for the supply of energy is once again close to the pivot axis 6. At the same time, a multiple number of operating components 14 may be pivoted from the maintenance position I, shown in the present case, into the inspection position II, which is not shown, which simplifies the inspection and saves time. Of course, the pivot axis 6 could also be arranged in another place, for example in the middle of the operating unit 2.

Figure 5:
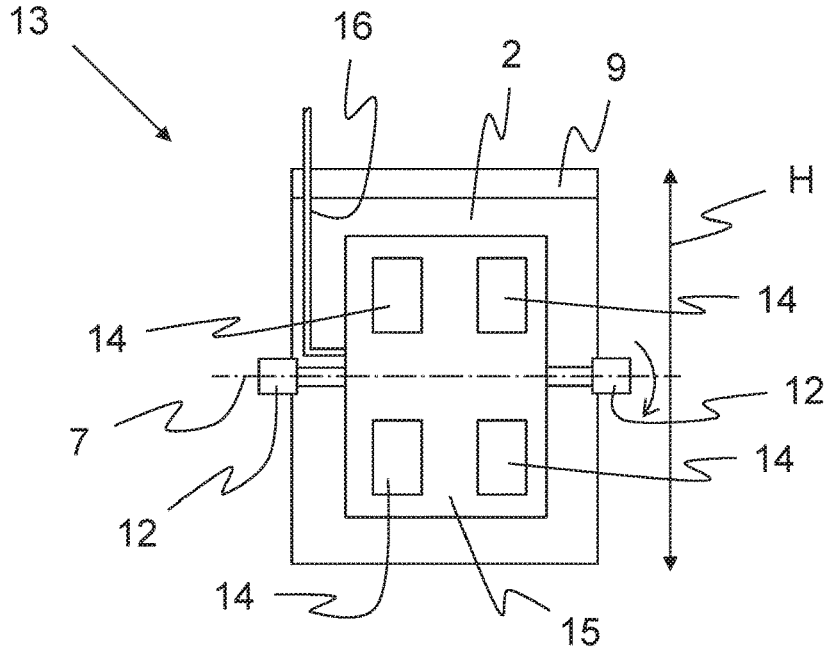
FIG. 5 is a schematic front view of a maintenance device with a pivotable operating component arranged on a carrier according to another design.

FIG. 5 also shows a maintenance device 13, the operating components 14 of which are arranged on a common carrier 15. However, the carrier 15 can be pivoted around a pivot axis 7, which is aligned parallel to the direction of travel 4 (see FIG. 1), as once again indicated by an arrow. Of course, here as well, the pivot axis 7 could also be arranged in another place in relation to the height H of the maintenance device 13.

This invention is not limited to the illustrated and described embodiments. Thus, numerous variations are possible, in particular with regard to the position of the pivot axes 6, 7. Furthermore, with reference to FIGS. 4 and 5, the carrier 15 could also be pivotable around both pivot axes 6, 7, or additional operating components 14 that are not arranged on the carrier 15, but are attached in a manner separately movable as in FIGS. 2 and 3 or fixed to the operating unit 2, could be present. In addition, of course, with the maintenance devices shown in FIG. 1, it is advantageous if the device 16 for the supply of energy is also connected to the operating unit 2 both in the maintenance position and in the inspection position, which is facilitated by an arrangement of the device 16 close to the pivot axis 6, 7. The guide unit 9 may, of course, also be designed differently and, for example, extend over the entire height of the maintenance device 13, or feature a frame, on which the operating unit 2 is in turn arranged.

Additional variations within the framework of the claims, such as a combination of features, are also possible, even if such are presented and described in different embodiments.

LIST OF REFERENCE SIGNS

1 Textile machine
2 Operating unit
3 Driving rail
4 Direction of travel
5 Gap
6 First pivot axis
7 Second pivot axis
8 Angle
9 Guide unit
10 Linkage
11 Work station
12 Swivel joint
13 Maintenance device
14 Operating component
15 Carrier
16 Device for the supply of energy
I Maintenance position
II Inspection position
H Height of the maintenance device

The invention claimed is:

1. A maintenance device for servicing adjacent work stations of a textile machine, the maintenance device movable along driving rails disposed along the work stations, the maintenance device comprising:

an operating unit that further comprises at least one operating component configured to perform a service operation on one or more working components of the work stations;

a mechanical guide unit configured to mechanically fix and move the maintenance device on the driving rails in a direction of travel alongside the work stations;

the maintenance device configurable from a maintenance position in which one of the work stations is serviceable by the maintenance device into an inspection position in which the maintenance device can be inspected; and wherein to bring the maintenance device from the maintenance position into the inspection position, the operating unit is pivotal relative to the guide unit and/or the operating component is movable relative to the operating unit.

2. The maintenance device according to claim 1, wherein the operating unit and/or the operating component are pivotal via a swivel joint.

3. The maintenance device according to claim 2, wherein the operating unit and/or the operating component are pivoted around a first pivot axis that is perpendicular to the direction of travel.

4. The maintenance device according to claim 1, wherein the operating unit and/or the operating component are pivoted around a second pivot axis that is aligned parallel to the direction of travel.

5. The maintenance device according to claim 1, wherein the operating unit comprises a plurality of the operating components arranged on the maintenance device so as to be movable together with respect to the operating unit.

6. The maintenance device according to claim 1, wherein the maintenance device comprises an energy supply device connected to the operating unit in the maintenance position and in the inspection position.

7. The maintenance device according to claim 1, wherein the maintenance device comprises a safety device configured to avoid collisions between other maintenance devices, wherein the safety device is effective when the maintenance device is in the inspection position.

8. The maintenance device according to claim 7, wherein the safety device is activated when the maintenance device is moved from the maintenance position into the inspection position.

9. The maintenance device according to claim 1, wherein the maintenance device comprises a safety device configured to switch off at least one part of the maintenance device in the inspection position of the maintenance device.

10. The maintenance device according to claim 1, wherein the maintenance device comprises an actuator that pivots or moves the operating unit and/or the operating component.

11. A textile machine, comprising a plurality of work stations arranged side by side, and with at least one maintenance device according to claim 1.

* * * * *